US008322936B2

(12) United States Patent
Ford et al.

(10) Patent No.: US 8,322,936 B2
(45) Date of Patent: Dec. 4, 2012

(54) TWO-BUTTON CUTTER ACTUATION MECHANISM

(75) Inventors: Thomas D. R. Ford, Royston (GB); Anthony R. Dunn, Whittlesford (GB); Clive Ayling, Great Shelford (GB); Trevor J. Penhallurick, Welwyn (GB)

(73) Assignee: Brady Worldwide, Inc., Milwaukee, WI (US)

( * ) Notice: Subject to any disclaimer, the term of this patent is extended or adjusted under 35 U.S.C. 154(b) by 592 days.

(21) Appl. No.: 12/613,893

(22) Filed: Nov. 6, 2009

(65) Prior Publication Data

US 2010/0119285 A1 May 13, 2010

Related U.S. Application Data

(60) Provisional application No. 61/113,123, filed on Nov. 10, 2008.

(51) Int. Cl.
*B41J 11/70* (2006.01)

(52) U.S. Cl. ..... 400/621; 400/88

(58) Field of Classification Search ..... 400/621, 400/88; 347/157

See application file for complete search history.

(56) References Cited

U.S. PATENT DOCUMENTS

| | | | | |
|---|---|---|---|---|
| 4,139,744 | A * | 2/1979 | Pypno | 381/123 |
| 5,224,786 | A | 7/1993 | Takagi et al. | |
| 6,113,293 | A | 9/2000 | Schanke et al. | |
| 6,602,009 | B2 | 8/2003 | Sodeyama | |
| 6,732,619 | B2 | 5/2004 | Carriere et al. | |
| D491,977 | S | 6/2004 | Shimoki | |
| 7,819,599 | B2 * | 10/2010 | Kobayashi et al. | 400/621 |
| 2002/0136584 | A1 | 9/2002 | McCleave et al. | |
| 2003/0077099 | A1 | 4/2003 | Tanaka et al. | |
| 2004/0218957 | A1 | 11/2004 | Cockerill et al. | |
| 2006/0118314 | A1 * | 6/2006 | Aeberhard et al. | 173/1 |
| 2006/0133882 | A1 | 6/2006 | Adams et al. | |
| 2008/0298872 | A1 * | 12/2008 | Kubota et al. | 400/621 |
| 2009/0096919 | A1 * | 4/2009 | Wang et al. | 348/376 |

FOREIGN PATENT DOCUMENTS

JP 08011372 A * 1/1996

OTHER PUBLICATIONS

International Search Report for PCT/US2009/063527, mailed Feb. 23, 2010, 2 pages.

* cited by examiner

*Primary Examiner* — Daniel J Colilla

(74) *Attorney, Agent, or Firm* — Quarles & Brady LLP

(57) ABSTRACT

A cutter actuation mechanism for cutting printing media in handheld printer is disclosed. The cutter actuation mechanism includes a cutting mechanism having an open position and a cut position. The cutter actuation mechanism further includes a pair of buttons operatively connected to the blade to move the blade from the open position to the cut position. Depressing at least one of the pair of buttons moves the blade from the open position to the cut position.

19 Claims, 5 Drawing Sheets

FIG. 5
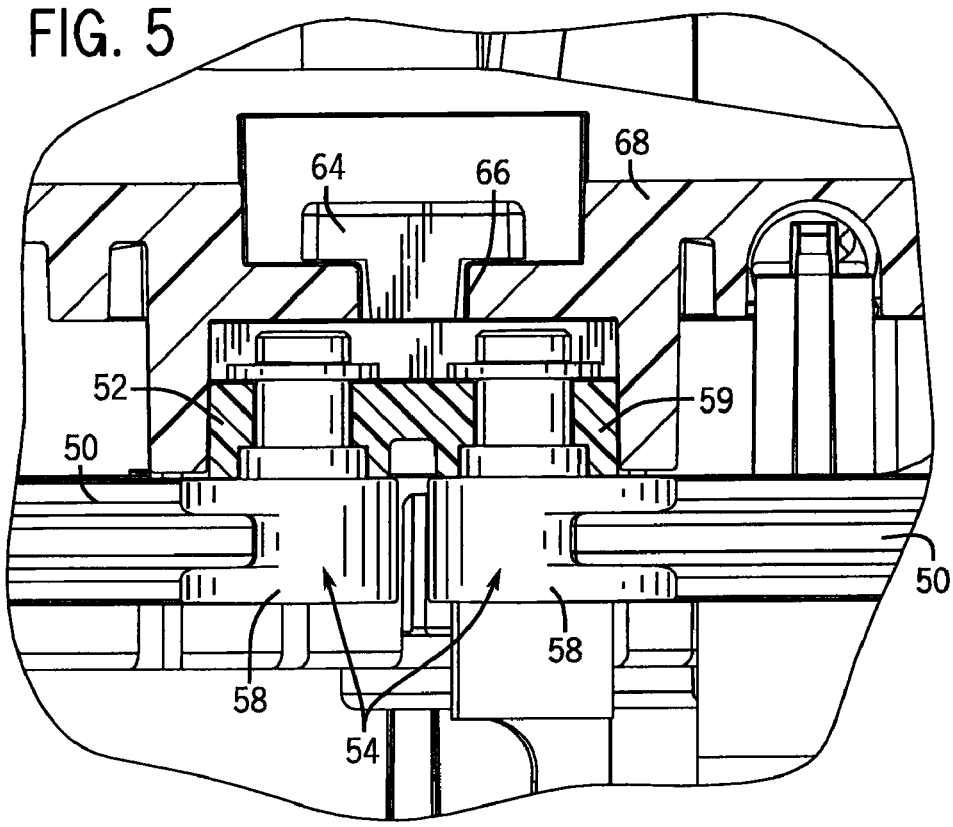
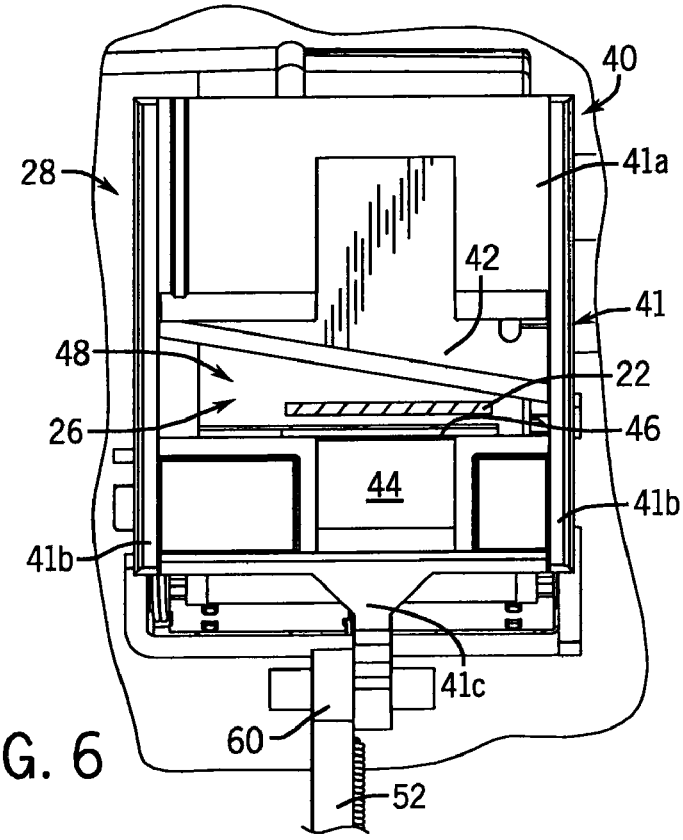
FIG. 6

TWO-BUTTON CUTTER ACTUATION MECHANISM

CROSS-REFERENCE TO RELATED APPLICATION

This application claims the benefit of U.S. Provisional Patent Application No. 61/113,123 filed Nov. 10, 2008, the disclosure of which is hereby incorporated by reference in entirety.

STATEMENT OF FEDERALLY SPONSORED RESEARCH OR DEVELOPMENT

Not applicable.

BACKGROUND OF THE INVENTION

This invention relates to printers. In particular, this invention relates to the manner in which a cutting mechanism for printing media is actuated in a handheld printer.

Handheld printers are used to print labels for application to documents, folders, packaging, and other items. Handheld printers provide flexibility in the location at which labels can be printed, as such printers are portable and are usually not physically tethered to a computer.

Given handling and mobility considerations, handheld printers typically print onto rolls of printing media which are housed in a protective cartridge. As the printing occurs, the printing media is fed from the roll, past a print head, and to the exterior of the handheld printer.

Periodically, a portion of the printing media that has been printed upon may need to be separated from the rest of the roll. Conventionally, an user-operated cutting mechanism on the discharge slot of the printer is used to cut the media as necessary.

Actuation of the cutting mechanism is typically independent of the printing operation. This independence allows, for example, a number of items to be printed on a single strip of printing media without automatically severing the items from one another. However, this independence in operation also requires that the user perform a separate independent action to cut the media.

Frequently, the cutter actuation mechanism is in the form of a sliding button or a lever that actuates a blade. When the user slides the button or moves the lever, the blade is forced through the media to cut it.

However, it may be awkward for the user to operate the cutter. The operation of the sliding button or lever may require the use of both of the user's hands - one hand to hold the printer and one hand to operate the cutter. Further, most handheld printers are designed with right-handed ergonomics in mind, making left-handed operation of the cutter clumsy.

Other actuation mechanisms may require long travel distances for the button or lever to achieve the amount of motion necessary to actuate the blades. This long travel distance may strain the hand of the user during operation. Particularly at the end of the motion, the user may have difficulty providing the force required to complete the cut.

Hence, a need exists for an improved cutter actuation mechanism. In particular, there is a need for a cutter actuation mechanism that is easily operable by left and right-handed users and that reduces the force required throughout actuation.

SUMMARY OF THE INVENTION

A cutter actuation mechanism for a handheld printer for printing on a media is disclosed. The cutter actuation mechanism includes a cutting mechanism having a blade movable between an open position that allows passage of the media through a gap in the cutting mechanism and a cut position. The cutter actuation mechanism further includes a pair of buttons operatively connected to the blade to move the blade from the open position toward the cut position. The cutting mechanism is actuated by depressing at least one of the pair of buttons to move the blade from the open position toward the cut position.

In one form, the pair of buttons may be located on opposing sides of the handheld printer.

In another form, the cutter actuation mechanism further includes linkages that operatively connect the pair of buttons to the blade. The linkages may include a pair of first linkages, each of the pair of first linkages being connecting to one of the pair of buttons, and a second linkage that connects the pair of first linkages to the cutting mechanism.

In still yet another form, the cutter actuation mechanism may also include a biasing mechanism that biases the blade to the open position.

A handheld printer for printing on a printing media is also disclosed. The handheld printer includes a cutting mechanism. The cutting mechanism has a blade movable between an open position and a cut position. The handheld printer further includes a pair of buttons, a pair of first linkages, and a second linkage. Each of the pair of first linkages connect to one of the pair of buttons. The second linkage connects the pair of first linkages to the cutting mechanism. When one or more of the buttons are pressed, the button(s) actuate at least one of the first linkages which actuates the second linkage which moves the blade from the open position toward the cut position.

According to one form, the handheld printer further may include a biasing mechanism that biases the cutting mechanism to the open position. The biasing mechanism may be a spring that biases at least one of the pair of first linkages and the second linkage.

According to another form, the pair of first linkages each may connect to the second linkage proximate one another at an inter-linkage joint.

According to still yet another form, a linear bearing may restrict a range of motion of the second linkage to linear translational movement.

According to yet another form, the cutting mechanism may include a moving portion and a stationary portion.

According to still yet another form, the pair of buttons may be placed on opposite sides of a housing of the handheld printer. The pair of buttons may be placed symmetrically about a centerline of the housing.

According to another form, the printer may be a thermal transfer printer.

A method of cutting printing media in a handheld printer is also disclosed. The method includes printing on a printing media; feeding a free end of the printing media from a discharge slot on the handheld printer; pressing at least one of a pair of buttons on the handheld printer to actuate a linkage assembly connected to a cutting mechanism; and cutting the printing media using the cutting mechanism by actuation of the linkage assembly.

In one form, the pair of buttons may be placed on opposing sides of the handheld printer such that pressing at least one of the pair of buttons includes pinching the pair of buttons towards one another.

In another form, the linkage assembly may include a pair of first linkages and a second linkage. Each of the pair of first linkages may connect the pair of buttons to the second linkage. The second linkage may connect the pair of first linkages to the cutting mechanism.

Thus, a cutter actuation mechanism for a handheld printer is disclosed that provides improved operability. The cutter actuation mechanism for the handheld printer can reduce the force required over the travel distance, making the cutter easier to actuate. Further, the cutter actuation mechanism has a structure that allows for actuation via the movement of two buttons towards one another. The "pinching" actuation motion eliminates a preferred handedness for the operation of the actuation mechanism, providing comfortable operation for both left and right-handed individuals.

These and still other advantages of the invention will be apparent from the detailed description and drawings. What follows is merely a description of a preferred embodiment of the present invention. To assess the full scope of the invention, the claims should be looked to as the preferred embodiment is not intended to be the only embodiment within the scope of the claims.

BRIEF DESCRIPTION OF THE DRAWINGS

FIG. 5 is a cross-sectional view of the inter-linkage joint of the handheld printer taken along line 5-5 in FIG. 3; and FIG. 6 is a cross-sectional view of the cutting mechanism in an open position taken along line 6-6 in FIG. 3.

DETAILED DESCRIPTION OF THE PREFERRED EMBODIMENT

Figure 1:
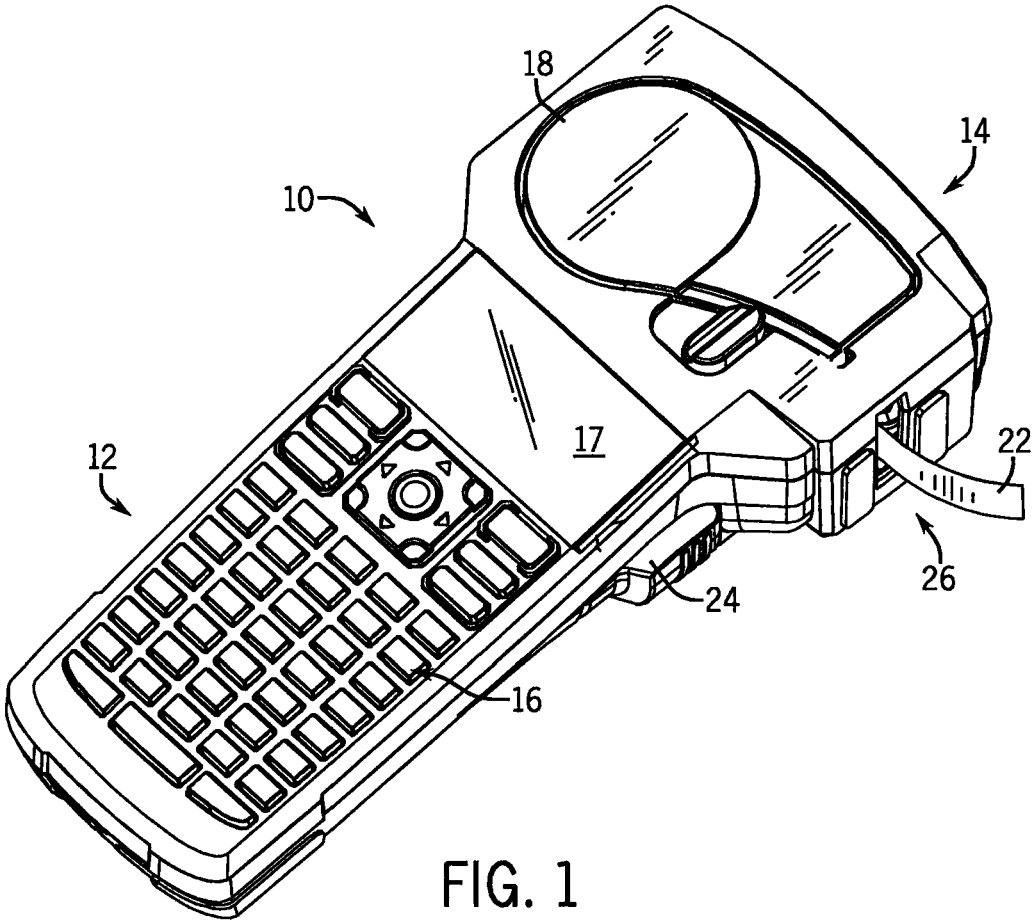
FIG. 1 is a front side perspective view of a handheld printer.
Figure 2:
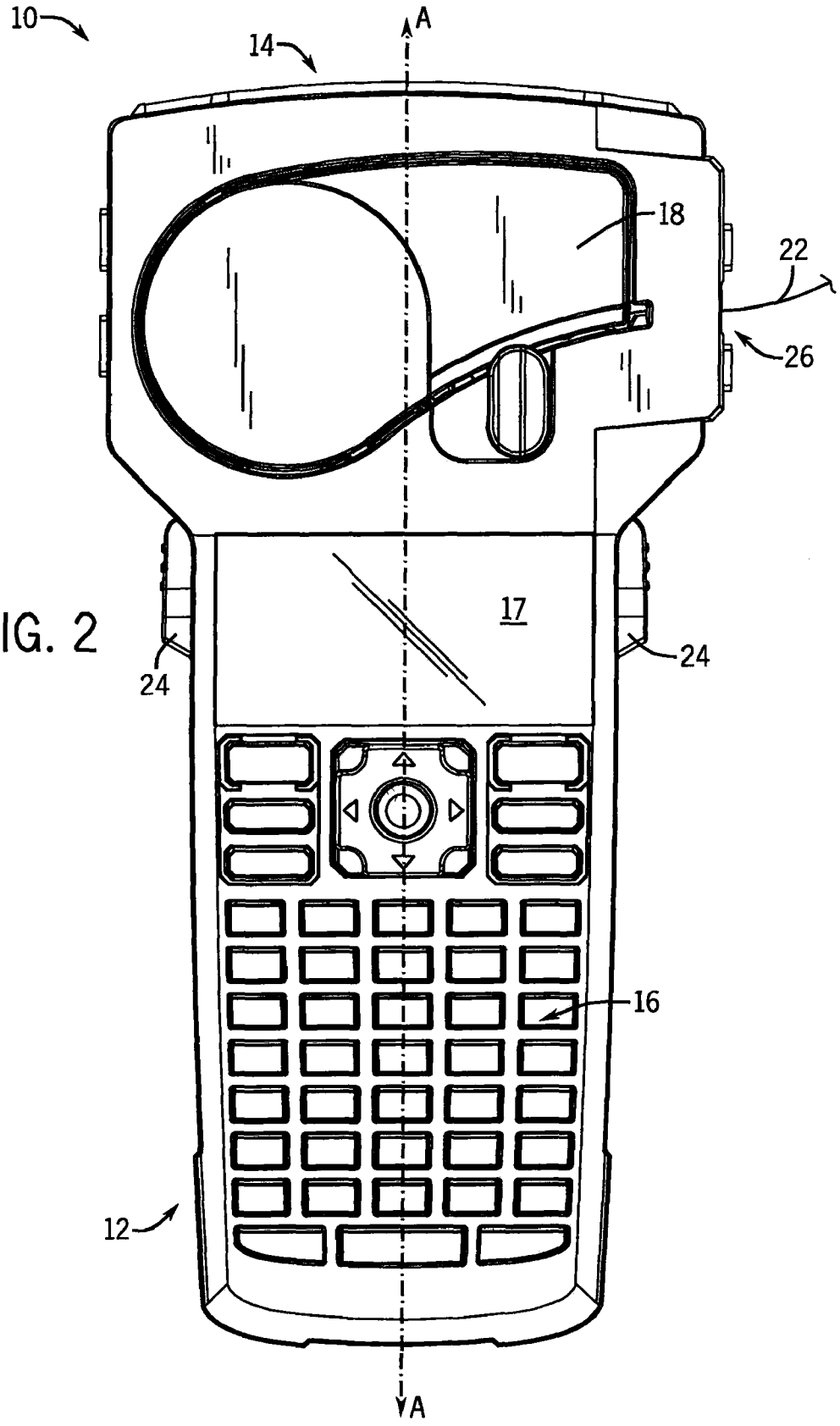
FIG. 2 is a front plan view of the handheld printer.

Referring first to FIGS. 1 and 2, a handheld printer 10 is shown. The handheld printer 10 has a body portion 12 and a head portion 14. The body portion 12 includes a keypad 16 for entering data and operating the handheld printer 10 and also includes a display screen 17 for displaying an user interface. The head portion 14 is adapted to removably receive a cartridge 18. The cartridge 18 houses a roll 20 (partially seen in FIGS. 3 and 4) of printing media 22 such as, for example, adhesive-backed labels. A free end of the printing media 22 extends through a discharge slot 26 formed on in a lateral side of the head portion 14 of the handheld printer 10.

Notably, on the lateral sides of the body portion 12 of the handheld printer 10 there are a pair of buttons 24. The pair of buttons 24 is linked to a cutting mechanism 28 that can sever the free end of the printing media 22. Preferably, the pair of buttons 24 are located on opposing sides of the handheld printer 10 such that the pair of buttons 24 can be pushed or actuated towards the body portion 12 and, at the same time, towards one another by a pinching motion. The pair of buttons 24 are placed symmetrically about a centerline A-A of the body portion 12. In other forms, however, the pair of buttons 24 may be placed differently on the body portion 12 to accommodate other designs or to achieve a particular ergonomic layout.

Figure 3:
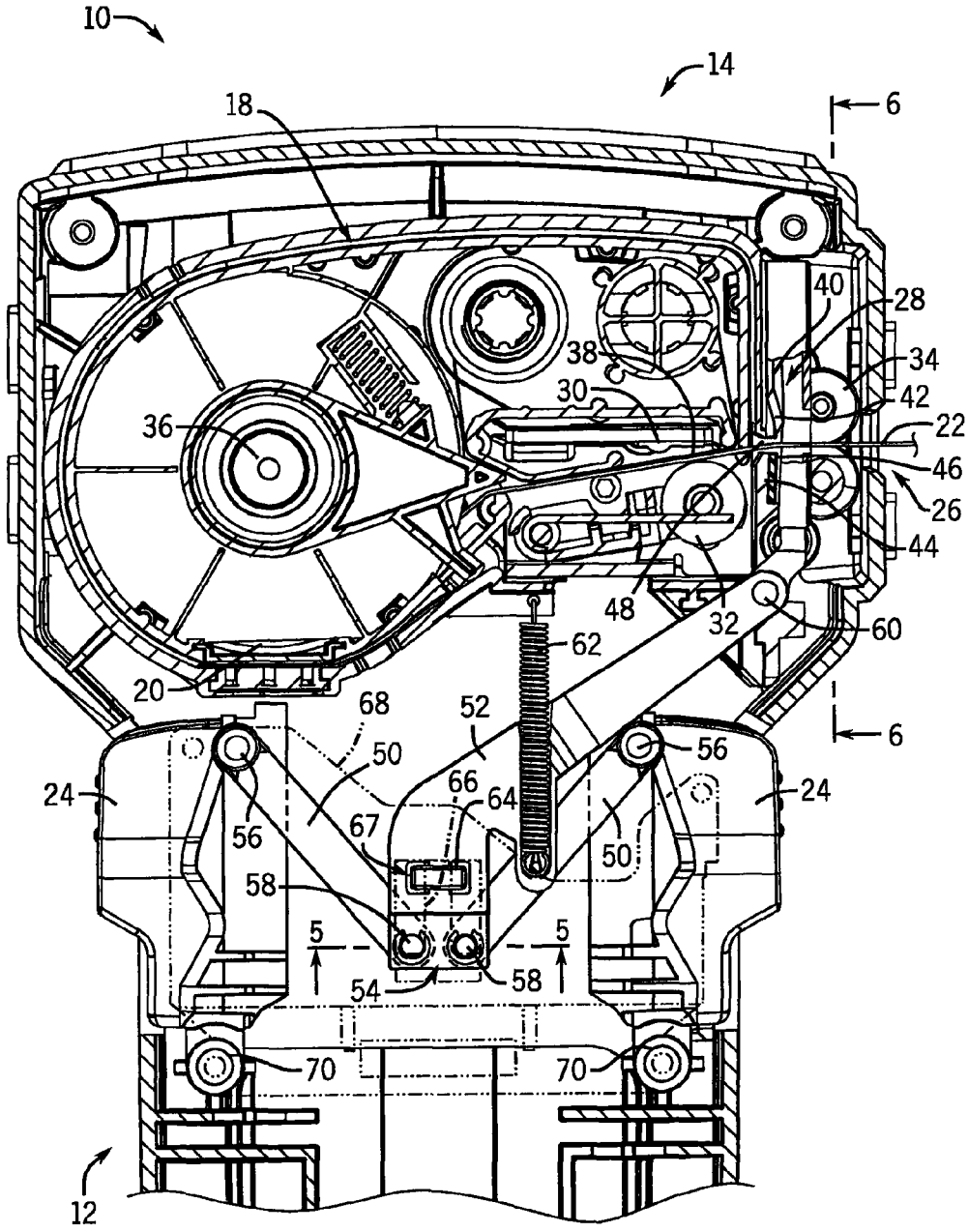
FIG. 3 is a cross-sectional view of the handheld printer in which the cutting mechanism is in the open position.
Figure 4:
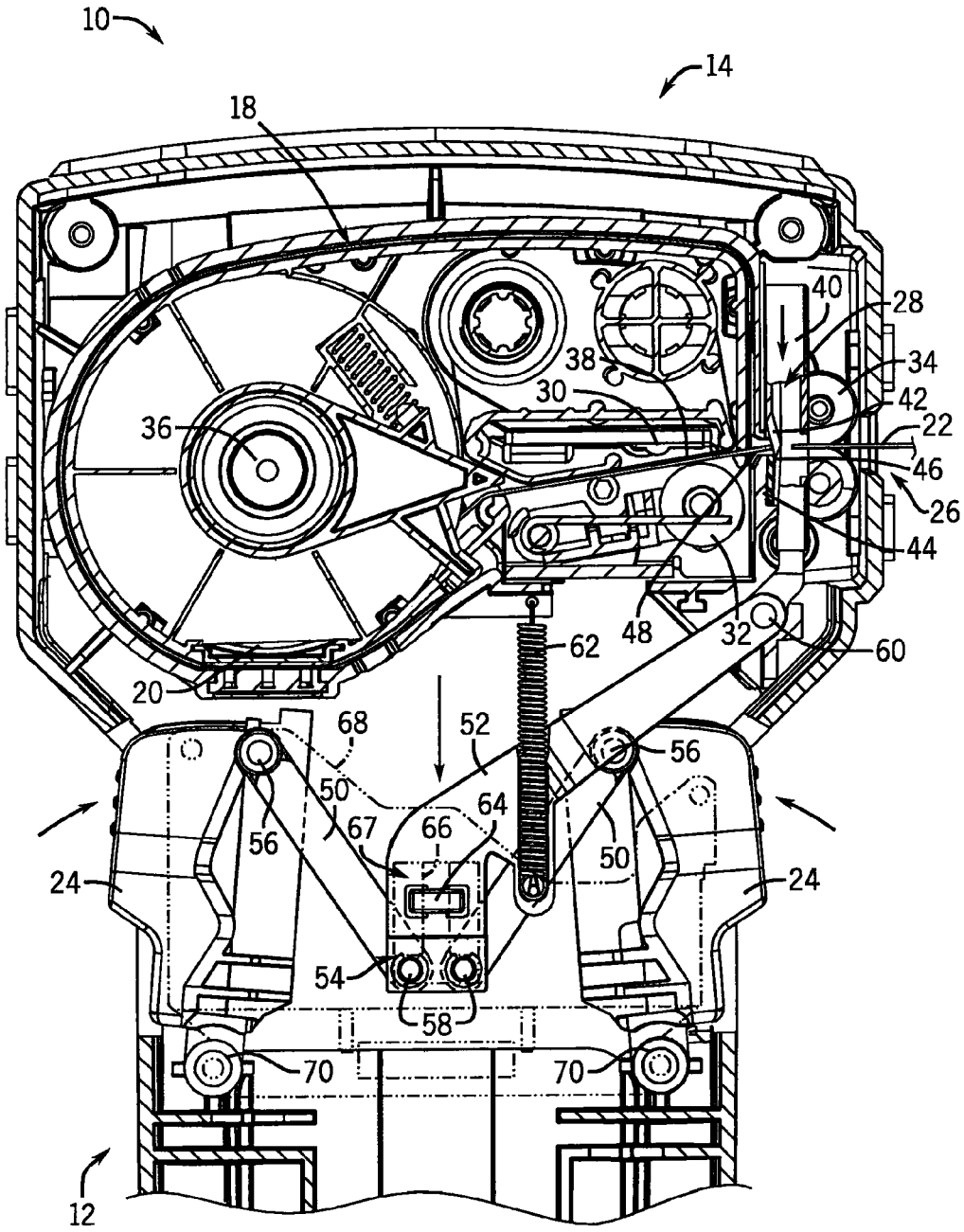
FIG. 4 is a cross-sectional view of the handheld printer in which the pair of buttons are depressed and the cutting mechanism is in the cut position.

Referring now to FIGS. 3 and 4, the internal components of the handheld printer 10 can be seen. More specifically, the details of the cartridge 18, the printing components, and a cutter actuation mechanism are shown in detail.

In FIGS. 3 and 4, the cartridge 18 is shown after being loaded into the handheld printer 10. On the left side of cartridge 18 (as viewed from the front of the handheld printer 10), the roll 20 of printing media 22 is centered on a spool 36. The printing media 22 extends from the roll 20 to the right side of the cartridge 18. As the printing media 22 extends rightward, the printing media 22 is threaded between a thermal print head 30 and a platen 32, through a cutting mechanism 28, through nip rollers 34, and out of the discharge slot 26 of the handheld printer 10.

The cutter actuation mechanism is also seen in FIGS. 3 and 4. The cutter actuation mechanism includes the pair of buttons 24, the cutting mechanism 28, and the linkage assembly that links the pair of buttons 24 to the cutting mechanism 28.

The cutting mechanism 28 is located proximate the discharge slot 26 of the handheld printer 10. The cutting mechanism 28 includes a moving blade assembly 40 having a cutter blade 42 mounted in a slidable frame 41. As shown, the slidable frame 41 includes a top bar 41*a* spaced from a bottom bar 41*c*. Two side bars 41*b* extending down from the top bar 41*a* join the top bar 41*a* to the bottom bar 41*c*. The blade 42 is mounted in the slidable frame 41 proximal the top bar 41*a* and between the side bars 41*b*.

The blade assembly 40, and thus the blade 42, moves between an open position and a cut position. In the open position seen in FIGS. 3 and 6, the blade 42 is spaced from a breaker bar 44 defining a gap 48 through which the printing media 22 extends. As the blade assembly moves toward the cut position seen in FIG. 4, the blade 42 engages the breaker bar 44 to cut the printing media 22 extending through the gap 48. Preferably, the blade 42 is angled relative to the breaker bar 44.

The blade assembly, and thus the blade 42, is operatively connected to the pair of buttons by the linkage assembly. The linkage assembly includes a pair of first linkages 50 and a second linkage 52. Each of the pair of first linkages 50 have an end 56 pivotally attached to one of the pairs of buttons 24 and an end 58 pivotally attached to an end 59 of the second linkage 52 at an inter-linkage joint 54. The second linkage 52 also has an end 60 that is linked to the cutting mechanism 28.

The linkages are restricted in their range of motion by the components to which they are connected. The motion of the linkages will be described as viewed from the front of the handheld printer 10, such that the head portion 14 extends upward, the body portion 12 extends downward, and the pair of buttons 24 are on the left and right sides. For reference, the centerline A-A extends vertically through the handheld printer 10.

Preferably, as seen in FIG. 5, the second linkage 52 has a t-shaped tab 64 that interacts with a slot 66 in a slot plate 68 (shown in phantom in FIGS. 3 and 4) to serve as a linear slide bearing 67 proximate the inter-linkage joint 54. This restricts the range of motion of the second linkage 52 to linear translation in a direction parallel to A-A.

A biasing mechanism connected to one or more of the linkages biases the linkage assembly to a preferred position. In the form shown, a tension spring 62 is connected from the second linkage 52 to a fixed portion of body of the handheld printer 10 above the second linkage 52. This tension spring 62 biases the second linkage 52 upward.

Preferably, each of the pair of buttons 24 is restricted in movement by the pivot joints 70 near the lower end of each of the pair of buttons 24. This means that when depressed, the pair of buttons 24 swing inward towards centerline A-A, but are also restricted about their pivot joints 70.

In general operation of the handheld printer 10, the user first prints on the printing media 22, which is then advanced through the discharge slot 26. The user then presses one or both of the pair of buttons 24 to actuate the cutting mechanism 28 to sever the media that has been printed on from the roll 20.

During the printing portion of operation, the printing media 22 is pulled from the roll 20 past the thermal print head 30 by the platen 32 to print on the printing media 22. An ink ribbon 38 is simultaneously fed across the thermal print head 30, and the selective heating of the thermal print head 30 transfers the ink from the ink ribbon 38 onto the printing media 22. As is known, the platen 32 urges the ink ribbon 38 and printing media 22 against the thermal print head 30 to ensure the heated ink transfers from the ink ribbon 38 onto the printing media 22.

Once the printing media 22 has been printed on and passes through the gap 48, the cutting mechanism 28 is actuated to sever the portion of the printing media 22 that has been printed on from the rest of the printing media 22. As each of the pair of buttons 24 is linked to the operation of the cutting mechanism 28, if either of the pair of buttons 24 is pressed, the cutter actuation mechanism actuates the cutting mechanism 28 via the linkage assembly.

To initiate the cutting operation, an operator depresses one or both of buttons 24. Depressing one of the buttons 24 moves the linkage assembly in the following manner to operate the cutting mechanism 28. During pressing, the leftmost of the pair of buttons 24 rotates clockwise and the rightmost of the pair of buttons 24 rotates counter-clockwise. Accordingly, the leftmost of the pair of first linkages 50 rotates clockwise when the pair of buttons 24 is pressed inward, while the rightmost of the pair of first linkages 50 rotates counter-clockwise when the pair of buttons 24 is pressed inward. This rotation causes the ends 58 of the pair of first linkages 50 near the inter-linkage joint 54 to move downward, resulting in the downward linear translation of the second linkage 52. The downward linear translation of the second linkage 52 is transferred to the blade assembly 40 of the cutting mechanism 28 by the other end 60 of the second linkage 52. This movement transferred to the cutting mechanism 28 moves the blade assembly 40 of the cutting mechanism 28 downward.

During the cutting operation, the cutting mechanism 28 moves from an open position, as seen in FIG. 3, to a cut position, as seen in FIG. 4. In the open position, the portions of the cutting mechanism 28 are separated to allow the printing media to pass through the gap 48. In the cut position, the blade assembly 40 has been actuated downward so that the blade 42 moves towards the static edge 46 of the breaker bar 44. In the cut position, the blade 42 has traversed the gap 48 to cut through any printing media 22 that is present in the gap 48.

Because the spring 62 acts as a biasing mechanism, there will be a tendency for the cutting mechanism 28 to return to the open position. This is preferable as when the handheld printer 10 is printing to the printing media 22, the printing media 22 can be fed through the gap 48 and out the discharge slot 26 without interruption. Then, as described above, when the pair of buttons 24 are pressed with sufficient force, then the linkages stretch the spring 62 to actuate the cutter actuation mechanism and move the cutting mechanism 28 to the cut position. Upon release of the pair of buttons 24, the spring 62 will lift the second linkage 52 and the cutting mechanism 28 will return to the open position.

Of course, the biasing mechanism can be varied. Although a spring is shown as the biasing mechanism, other forms of biasing are contemplated. Flexible materials, magnets, hydraulics, and other biasing mechanisms known to those skilled in the art could also be used. Moreover, the biasing mechanism does not need to extend from a movable linkage to a stationary portion of the handheld printer 10. The biasing mechanism could extend from one movable linkage to another movable linkage, wherein the distance between points of connection of the movable linkages and the biasing mechanism varies when the cutting actuation mechanism is actuated.

It should be appreciated that although the cutting mechanism 28 is shown to include a blade assembly 40 and a breaker bar 44, that other forms of cutting are contemplated. For example, the cutting mechanism may include two moving portions that slide past one another. In another form, the cutting mechanism may include a single blade that traverses a gap and slides past a lower surface also having a blade. Further, the cutting blade or blades may cut through the width of the printing media all at once or from one side to another side (similar in manner to the way in which a pair of scissors works). Moreover, different types of blades may be used. For example, a flat blade, a serrated blade, a toothed blade, or any other type of blade could be used.

It should be appreciated that although a particular form of the invention has been shown, that other forms are also contemplated. For example, the positioning, shape, and arrangement of the buttons, the linkages, and the cutting mechanism could be altered without deviating from the scope of the invention. Further, the manner in which the linkages are restricted may vary. Additionally, there may be further linkages in the cutter actuation mechanism to transmit the motion as necessary from the pair of buttons 24 to the cutting mechanism 28.

As either of the pair of buttons 24 can actuate the cutting mechanism 28, this layout provides more flexibility in the way that the cutting mechanism 28 is operated. The cutter actuation mechanism of handheld printer 10 is easily actuated by either a left-handed or a right-handed individual. A user can select to press the button desired using a dominant finger or may elect to pinch or squeeze both buttons during cutting.

Further, when both of the pair of buttons 24 are pressed, the user may provide a relatively low force or have a shorter actuation distance when compared to other commonly used actuation mechanisms.

Many modifications and variations to this preferred embodiment will be apparent to those skilled in the art, which will be within the spirit and scope of the invention. For example, the linkages and the cutting mechanism can be arranged in such a way that the pinching of the pair of buttons causes the second linkage to be translated upward to move a portion of the cutting mechanism. In another example, the second linkage could rotate during the actuation, rather than only linearly translating. Therefore, the invention should not be limited to the described embodiment. To ascertain the full scope of the invention, the following claims should be referenced.

INDUSTRIAL APPLICABILITY

The invention provides a handheld printer with a cutter actuation mechanism that has a pair of buttons for actuating the cutting mechanism such that pressing any of the buttons will actuate the cutting mechanism.

What is claimed is:

1. A cutter actuation mechanism for a handheld printer for printing on a media, the cutter actuation mechanism comprising:

a cutting mechanism having a blade movable between an open position that allows passage of the media through a gap in the cutting mechanism and a cut position;

a pair of buttons operatively connected to the blade to move the blade from the open position toward the cut position; and linkages operatively connecting the pair of buttons to the blade;

wherein depressing at least one button of the pair of buttons moves the blade from the open position toward the cut position.

2. The cutter actuation mechanism as in claim 1, wherein the pair of buttons are located on opposing sides of the handheld printer.

3. The cutter actuation mechanism as in claim 1, wherein the linkages include:

a pair of first linkages, each of the pair of first linkages connecting to one of the pair of buttons; and a second linkage connecting the pair of first linkages to the cutting mechanism.

4. The cutter actuation mechanism as in claim 1, further comprising a biasing mechanism that biases the blade to the open position.

5. The cutter actuation mechanism as in claim 1, wherein the linkages mechanically connect the pair of buttons to the blade.

6. A handheld printer for printing on a printing media, the handheld printer comprising:

a cutting mechanism having a blade movable between an open position and a cut position;

a pair of buttons;

a pair of first linkages, each of the pair of first linkages connecting to one of the pair of buttons;

a second linkage connecting the pair of first linkages to the cutting mechanism; and wherein, when at least one button of the pair of buttons is pressed, the at least one button of the pair of buttons actuate at least one of the linkages of the pair of first linkages which actuates the second linkage which moves the blade from the open position toward the cut position.

7. The handheld printer of claim 6, further comprising a biasing mechanism that biases the cutting mechanism to the open position.

8. The handheld printer of claim 7, wherein the biasing mechanism is a spring that biases at least one of the pair of first linkages and the second linkage.

9. The handheld printer of claim 6, wherein the pair of first linkages each connect to the second linkage proximate one another at an inter-linkage joint.

10. The handheld printer of claim 6, wherein a linear bearing restricts a range of motion of the second linkage to linear translational movement.

11. The handheld printer of claim 6, wherein the cutting mechanism comprises a moving portion and a stationary portion.

12. The handheld printer of claim 6, wherein the pair of buttons are placed on opposite sides of a housing of the handheld printer.

13. The handheld printer of claim 12, wherein the pair of buttons are placed symmetrically about a centerline of the housing.

14. The handheld printer of claim 6, wherein the printer is a thermal transfer printer.

15. The handheld printer of claim 6, wherein the pair of first linkages and the second linkage mechanically connect the pair of buttons to the blade.

16. A method of cutting printing media in a handheld printer comprising:

printing on a printing media;

feeding a free end of the printing media from a discharge slot on the handheld printer;

pressing at least one of a pair of buttons on the handheld printer to actuate a linkage assembly connected to a cutting mechanism wherein the pair of buttons are placed on opposing sides of the handheld printer such that pressing at least one of the pair of buttons includes pinching the pair of buttons towards one another; and cutting the printing media using the cutting mechanism by actuation of the linkage assembly.

17. The method of cutting printing media as in claim 16, wherein the linkage assembly mechanically connects the pair of buttons to the cutting mechanism.

18. A method of cutting printing media in a handheld printer comprising:

printing on a printing media;

feeding a free end of the printing media from a discharge slot on the handheld printer;

pressing at least one of a pair of buttons on the handheld printer to actuate a linkage assembly connected to a cutting mechanism wherein the linkage assembly includes a pair of first linkages and a second linkage, each of the pair of first linkages connecting the pair of buttons to the second linkage and the second linkage connecting the pair of first linkages to the cutting mechanism; and cutting the printing media using the cutting mechanism by actuation of the linkage assembly.

19. The method of cutting printing media as in claim 18, wherein the linkage assembly mechanically connects the pair of buttons and the cutting mechanism.

* * * * *